United States Patent [19]

Payne

[11] 4,395,238

[45] Jul. 26, 1983

[54] OUTBOARD MOTOR MOUNTING MEANS AFFORDING UPWARD TILTING WITHOUT TRAVEL OF THE MOTOR FORWARDLY OF THE BOAT TRANSOM

[75] Inventor: Guy D. Payne, Lake Villa, Ill.

[73] Assignee: Outboard Marine Corporation, Waukegan, Ill.

[21] Appl. No.: 236,319

[22] Filed: Feb. 20, 1981

[51] Int. Cl.[3] ..... B63H 21/26

[52] U.S. Cl. ..... 440/53; 440/61; 248/642; 248/640

[58] Field of Search ..... 440/53, 57, 58, 59, 440/60, 61, 62, 63, 65; 248/640, 641, 642, 643

[56] References Cited

U.S. PATENT DOCUMENTS

| | | | |
|---|---|---|---|
| 1,172,176 | 2/1916 | Stanley | 248/642 |
| 1,204,739 | 11/1916 | Buehner | 248/643 |
| 1,511,867 | 10/1924 | Asbury | 440/55 |
| 3,269,351 | 8/1966 | Shimanckas | 440/65 |
| 3,339,517 | 9/1967 | Bergstedt | 440/57 |
| 3,487,804 | 1/1970 | Kiekhaefer | 440/76 |
| 3,893,407 | 7/1975 | Hurst | 440/57 |

*Primary Examiner*—Trygve M. Blix
*Assistant Examiner*—C. T. Bartz
*Attorney, Agent, or Firm*—Michael, Best & Friedrich

[57] ABSTRACT

Disclosed herein is a marine propulsion device comprising a bracket adapted to be fixed to the transom of a boat and including a generally planar mounting surface engaged with the boat transom when the bracket is boat mounted, which bracket also includes a lower part having a lower bearing with a steering axis which extends generally vertically when the bracket is boat mounted, a member including a lower portion extending in the lower bearing and a pair of laterally spaced arms connected to the lower portion and respectively including upper horizontal bearings having a common axis located in spaced relation above the lower bearing, a steering arm fixed to the member for steerably rotating the member within the lower bearing about the generally vertical axis, a propulsion unit including a powerhead and a lower unit extending fixedly downwardly from the powerhead and including a rotatably mounted propeller, and trunnions on the powerhead adjacent the top thereof and received in the upper horizontal bearings for pivotally connecting the propulsion unit to the member for movement about the horizontal axis between a running position with the propeller submerged in water and with the propulsion unit located wholly aft of the bracket mounting surface and an elevated position with the propeller substantially out of the water and with the propulsion unit located wholly aft of the bracket mounting surface.

23 Claims, 4 Drawing Figures

OUTBOARD MOTOR MOUNTING MEANS AFFORDING UPWARD TILTING WITHOUT TRAVEL OF THE MOTOR FORWARDLY OF THE BOAT TRANSOM

The invention relates generally to marine propulsion devices. More particularly, the invention relates to outboard motors including steerable and tiltable propulsion units, and to arrangements for mounting such outboard motors on boat transoms in such manner as to permit propulsion unit movement between a normal running position with the propeller submerged in water and a raised position with the propeller substantially out of the water, without causing propulsion unit movement into engagement with the boat transom or forwardly over the top of the boat transom.

Attention is directed to U.S. Pat. No. 3,269,351 to Shimanckas issued Aug. 30, 1966, U.S. Pat. No. 4,355,986 to Stevens issued Oct. 26, 1982, U.S. Pat. No. 4,354,847 to Blanchard issued Oct. 19, 1982, and to the following U.S. patent applications:

Blanchard U.S. Ser. No. 167,337, filed July 9, 1980, Blanchard U.S. Ser. No. 189,143, filed Sept. 22, 1980, and Stevens U.S. Ser. No. 190,387, filed Sept. 24, 1980.

SUMMARY OF THE INVENTION

The invention provides a marine propulsion device comprising a bracket adapted to be fixed to the transom of a boat and including a generally planar mounting surface engaged with the boat transom when the bracket is boat mounted, which bracket also includes a lower part having a lower bearing with a steering axis which extends generally vertically when the bracket is boat mounted, a member including a lower portion extending in the lower bearing and a pair of laterally spaced arms connected to the lower portion and respectively including upper horizontal bearings having a common axis located in spaced relation above the lower bearing, a steering arm fixed to the member for steerably rotating the member within the lower bearing about the generally vertical axis, a propulsion unit including a powerhead and a lower unit extending fixedly downwardly from the powerhead and including a rotatably mounted propeller, and means on the powerhead adjacent the top thereof and cooperating with the upper horizontal bearings for pivotally connecting the propulsion unit to the member for movement about the horizontal axis between a running position with the propeller submerged in water and with the propulsion unit located wholly aft of the bracket mounting surface and an elevated position with the propeller substantially out of the water and with the propulsion unit located wholly aft of the bracket mounting surface.

The invention also provides a marine installation comprising a boat hull including a transom having therein an opening, and the marine propulsion device as specified immediately above and wherein the bracket includes an interior surface and an exterior surface, one of which surfaces includes the mounting surface which is fixed to the boat transom in encircling relation to the transom opening, and wherein the bracket also includes a central portion which extends from the mounting surface and which closes the transom opening.

In one embodiment in accordance with the invention, the marine propulsion device further includes extensible means extending between the member and the propulsion unit for displacing the propulsion unit about the horizontal axis.

In one embodiment in accordance with the invention, the transom bracket includes a central portion having therein an opening, the powerhead includes a substantially watertight engine compartment having, adjacent the front thereof, an opening, and the marine propulsion device further includes a flexible boot connected in watertight relation to the engine compartment so as to communicate through the engine compartment opening with the interior of the engine compartment, and connected in watertight relation to the bracket central portion so as to communicate through the bracket central portion opening with the atmosphere forwardly of the bracket, i.e., with the interior of the boat.

In one embodiment in accordance with the invention, the bracket central portion opening is located above the lower bearing.

In one embodiment in accordance with the invention, the generally vertical steering axis extends upwardly and forwardly.

In one embodiment in accordance with the invention, the generally vertical steering axis extends upwardly and rearwardly and intersects the horizontal axis.

In one embodiment in accordance with the invention the powerhead is located, in part, between the laterally spaced arms of the member.

In one embodiment in accordance with the invention, the lower bearing communicates between the interior surface and the exterior surface, the member comprises a yoke having a lower leg extending in the lower bearing and having a lower end, and the steering arm is connected to the lower end of the leg and extends forwardly of the transom bracket, i.e., into the boat.

In one embodiment in accordance with the invention, the lower part of the bracket includes a rearwardly open notch which separates the lower bearing into an upper part and a lower part, and a bushing is carried on the lower leg in the notch and includes oppositely laterally extending studs, and the marine propulsion device further includes a pair of extensible members respectively pivotally connected to the studs and to opposite sides of the propulsion unit.

In one embodiment of the invention, the transom bracket also includes an upper part having an upper bearing in generally vertical alignment with the lower bearing, the member includes an upper wall connecting the spaced arms and including an upper king pin extending through the upper bearing and having an upper end, and the member also includes a lower wall connecting the spaced arms and the lower portion comprises a lower king pin extending from the lower wall and located in the lower bearing.

In one embodiment of the invention, the member is open between the upper and lower walls and between the laterally spaced arms, and the powerhead is located, in part, between the upper and lower walls and the laterally spaced arms.

In one embodiment of the invention, the bracket has an interior surface and an exterior surface, the upper bearing has an upper end communicating with the interior surface, and the steering arm is fixed to the upper end of the upper king pin and extends forwardly of the bracket, i.e., into the boat.

Other features and advantages of the embodiments of the invention will become known by reference to the following general description, claims and appended drawings.

IN THE DRAWINGS

Figures 1, 2, 3, 4:
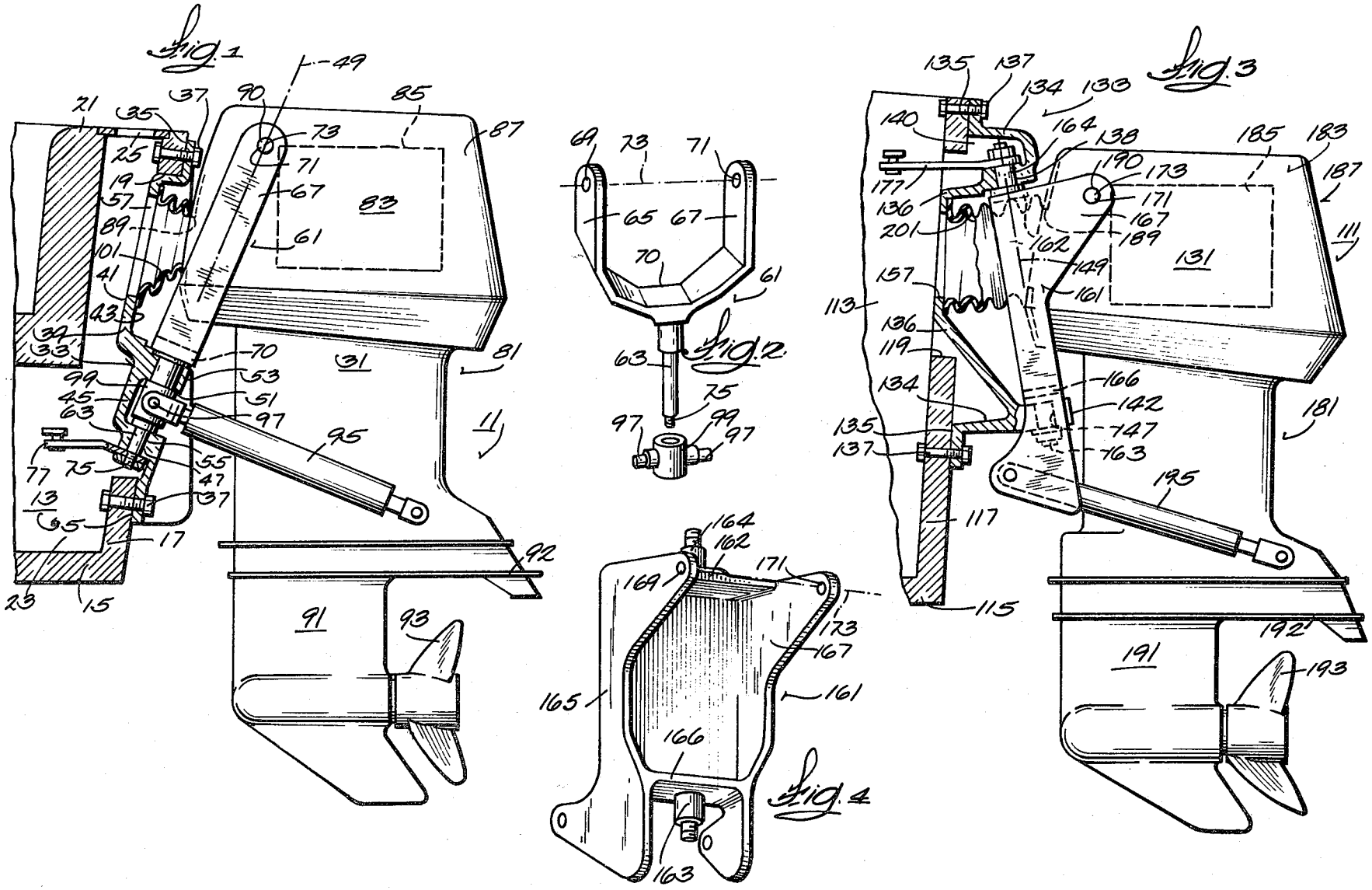
FIG. 1 is a side elevational view, partly in section, of a marine installation embodying various of the features of the invention.
FIG. 2 is a perspective view of two of the components incorporated in the marine installation shown in FIG. 1.
FIG. 3 is a side elevational view, partly in section, of a marine installation embodying various of the features of the invention.
FIG. 4 is a perspective view of one of the components of the marine installation shown in FIG. 3.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in FIG. 1 is a marine propulsion installation 11 including a boat 13 having a hull 15 including a transom 17 having therein an aperture or opening 19 which is circular but could otherwise be shaped. If desired, the boat 13 can include, adjacent to transom 17, a rear seat 21 extending across the boat hull 15 and defining, in part, a cavity or recess 23 between the seat 21 and the transom 17. The cavity or recess 23 has an upper portion which communicates with the atmosphere through an air intake 25.

Fixedly mounted on the boat transom 17 is a marine propulsion device which is in the form of an outboard motor 31 and which includes a transom bracket or member 33 having a planar mounting surface 35 engaging the rear of the boat transom 17 around the transom opening 19. Any suitable means, such as a plurality of bolts 37, and a gasket (not shown) can be employed to fix the mounting surface 35 to the rear of the boat transom 17 in watertight relation. If desired, the mounting surface could be fixed to the inside surface of the boat transom 17.

Inwardly of the planar mounting surface, the transom bracket 33 includes a central portion 39 which effectively closes the transom opening 19 and which includes an interior surface 41 and an exterior surface 43. In addition, the central portion 39 includes a lower part 45 including means defining a lower bearing 47 extending generally vertically and extending between the internal and exterior surfaces 41 and 43. In the specifically disclosed construction, the lower bearing 47 extends about a steering axis 49 which extends upwardly and slightly rearwardly. The lower bearing 47 could be located on a lug (not shown) extending from the planar mounting surface 35.

The lower part 45 is also formed with a rearwardly open recess or notch 51 which divides the lower bearing 47 into an upper portion 53 and a lower portion 55 and which is provided for a purpose which will be hereinafter explained.

In addition, the central portion 39 includes an upper part which includes an opening or aperture 57 for purposes which will be later explained.

The outboard motor 31 further includes a member 61 (See also FIG. 2) which includes a lower part or portion 63 extending into the lower bearing 47 for steering movement of the member 61 and which also includes a pair of laterally spaced arms 65 and 67 which extend from the lower part 63 and respectively include upper horizontal bearings 69 and 71 having a common horizontal axis 73 located in spaced relation above the lower vertically extending bearing 47 and rearwardly of the transom bracket 33. In the construction specifically illustrated in FIGS. 1 and 2, the member 61 comprises a yoke having a lower leg which constitutes a lower part 63, which extends through the lower bearing 47, and which has a lower end 75 fixed to a steering arm 77 which extends forwardly of the bracket mounting surface 35 through the transom opening 19 and into the recess or cavity 23 in the boat 13 for connection to any suitable means for effecting steering movement of the steering arm 77 to cause steering movement of the yoke member 61.

The lower leg or lower part 63 is connected to the spaced arms 65 and 67 through a transverse wall 70 which bears against the exterior surface 43 of the transom bracket 33 to support the weight imposed on the yoke member 61.

The outboard motor 31 further includes a propulsion unit 81 comprising a powerhead 83 which, in part, extends between the spaced arms 65 and 67 of the yoke member 61 and which includes an internal combustion engine 85 shown in dotted outline and located in an engine compartment 87 which is substantially sealed or watertight except for a forwardly located opening 89. The propulsion unit 81 further includes a lower unit 91 which extends rigidly downwardly from the powerhead 83 and includes a cavitation or anti-ventilation plate 92 and a rotatably mounted propeller 93 driven by the engine 85.

Provided on the upper forward part of the powerhead 83 is means in the form of studs or trunnions 90 cooperating with the horizontal bearings 69 and 71 at the ends of the yoke member arms 65 and 67 for mounting the propulsion unit 81 for pivotal movement between an operating or running position with the propeller 93 submerged in the water for propulsion and with the propulsion unit 81 located wholly aft the mounting surface 35 of the transom bracket 33, and a raised position with the propeller 93 located out of the water and with the propulsion unit 81 located wholly aft of the mounting surface 35 of the transom bracket 33.

The outboard motor 31 further includes extensible means connected to the yoke member 61 and to the propulsion unit 81 for tiltably displacing the propulsion unit 81 about the horizontal axis 73 between the running and raised positions. While various arrangements can be employed, in the illustrated construction, such means comprises a pair of two-way hydraulic cylinder piston assemblies 95 (one shown) which are respectively located on opposite sides of the propulsion unit 81, which at one end, are connected to the propulsion unit 81 adjacent the cavitation or antiventilation plate 92, and which at the other end, are connected to respective studs 97 extending oppositely from a bushing 99 (See also FIG. 2) encircling the lower leg 63 of the yoke member 61 in the rearwardly open notch on recess 51.

The outboard motor 31 further includes a flexible boot 101 which is connected, at one end, in watertight relation to the margin surrounding the opening 57 in the transom bracket 33 and, at the other end, in watertight relation to the margin of the engine compartment 87 surrounding the forwardly located opening 89. Accordingly, combustion air is supplied to the engine 85 through the air intake opening 25, through the recess or cavity 23 in the boat 13, through the opening 19 in the transom 17, through the opening 57 in the transom bracket 31, through the boot 101, and through the engine compartment opening 89 to within the engine compartment 87. If desired, various controls for operating various engine components can also extend through the boot 101 into the engine compartment 87.

The marine propulsion installation 11 shown in FIG. 1 permits tilting movement of the propulsion unit 81 between the running and raised positions without causing movement of any part of the propulsion unit 81 forwardly of the plane of the mounting surface 35 of the transom bracket 33. Thus, when in the raised position, the propulsion unit 81 does not engage the transom 17 and does not extend forwardly above the top of the transom 17.

Shown in FIG. 3 is another embodiment of a marine propulsion installation 111 which embodies various of the features of the invention and which includes a boat hull 115 with a transom 117 having therein an opening 119 which is preferably circular but which can be of other configurations, together with an outboard motor 131.

Mounted to the transom 117 by suitable means is a transom bracket 133 which constitutes a part of the outboard motor 131, and which includes a planar mounting surface 135 engaged with the transom 117 along the transom margin surrounding the transom opening 119. While the illustrated construction depicts the mounting surface 135 engaged with the outer surface of the transom 117, the mounting surface could be engaged with the inner transom surface. Any suitable means, such as a plurality of bolts 137, can be employed to connect the mounting surface 135 to the transom 117 in watertight relation.

Extending rearwardly from the planar mounting surface 135, the transom bracket 133 includes a cylindrical portion 134 which merges into an inturned portion 136 having, slightly above the center thereof, an opening or aperture 157 which can be located generally in the plane of the transom 117.

The inturned portion 136 also includes, at the upper part thereof, an upper bearing 138 which, at the upper end, communicates with the interior of the boat 113 through the space 140 between the rearwardly extending cylindrical portion 134 and the inturned portion 136 and through the transom opening 119. The upper bearing 138 defines a generally vertical steering axis 149 which preferably extends upwardly and slightly forwardly.

Extending rearwardly from the lower part of the junction between the rearwardly extending cylindrical portion 134 and the inturned portion 136, is an ear or lug 142 which includes a lower bearing 147 having an axis coincident with the steering axis 149.

The outboard motor 131 further includes a member 161 (See also FIG. 4) which comprises a lower portion 163 extending in the lower bearing 147 for steering movement of the member 161 and which also includes a pair of laterally spaced arms or side walls 165 and 167 which extend from the lower portion 163 and which respectively include upper bearings 169 and 171 having a common horizontal axis 173 located in spaced relation above the lower bearing 147 and rearwardly of the transom bracket 133.

In the specifically disclosed construction, the member 161 is generally of rectangular shape having an upper connecting wall 162 which extends between and interconnects the two side arms 165 and 167 and which includes a bearing stud 164 extending upwardly through the upper bearing 138. In addition, the member 161 includes a lower connecting wall 166 which extends between and interconnects the spaced arms or side walls 165 and 167 and which includes a lower bearing stud which constitutes the lower part 163 and which extends into the lower bearing 147. In general, the spaced between the side arms 165 and 167 and the upper and lower walls 162 and 166 is open.

The upper end of the upper stud 164 extends from the upper end of the upper bearing 138 and has fixedly connected thereto a steering arm 177 which extends forwardly through the transom opening 119 and which can be connected by any suitable arrangement within the boat hull 115 for swinging the steering arm 177 to thereby swing the member 161.

The outboard motor 131 further includes a propulsion unit 181 comprising a powerhead 183 which, in part, extends between the spaced arms 165 and 167 of the member 161 and which includes an internal combustion engine 185 which is shown in dotted outline and which is located in an engine compartment 187 which is substantially airtight except for a forwardly located opening 189. The propulsion unit 181 further includes a lower unit 191 which extends rigidly downwardly from the powerhead 183 and which includes a cavitation or anti-ventilation plate 192 and a rotatably mounted propeller 193 driven by the engine 185.

Provided on the upper forward part of the powerhead 183 is means in the form of studs or trunnions 190 cooperating with the upper bearings 169 and 171 on the spaced arms 165 and 167 of the member 161 for mounting the propulsion unit 181 for pivotal movement between a running position with the propeller 193 submerged in the water for propulsion and with the propulsion unit 181 located wholly aft of the mounting surface 135 of the transom bracket 133, and a raised position with the propeller 193 located out of the water and with the propulsion unit 181 located wholly aft of the mounting surface 135 of the transom bracket 133.

The outboard motor 131 further includes extensible means for tiltably displacing the propulsion unit 181 about the horizontal axis 173 between the running and raised positions. While various arrangements can be employed, in the illustrated construction, such means comprises a pair of two-way hydraulic cylinder piston assemblies 195 (one shown) which are respectively located on opposite sides of the propulsion unit 181, which at one end, are connected to the propulsion unit 181 adjacent the cavitation or anti-ventilation plate 192, and which, at the other end, are connected to respective lower end portions of the side arms 165 and 167, which lower end portions extend below the lower connecting wall 166.

The outboard motor 131 further includes a flexible boot 201 which is connected, at the one end, in watertight relation to the margin surrounding the aperture 157 in the transom bracket and, at the other end, in watertight relation to the margin of the engine compartment 187 surrounding the forwardly located opening 189. Accordingly, combustion air is supplied to the engine through the transom opening 119, and through the opening 157 in the transom bracket 133, through the boot 201, and through the engine compartment opening 189 to within the engine compartment 187. If desired, various controls for operating various engine components can also extend through the boot 201 into the engine compartment 187.

It is believed that the marine propulsion installation shown in FIG. 3 permits tilting movement of the propulsion unit 181 between the running and raised positions without causing movement of any part of the propulsion unit 181 forwardly of the plane of the mounting surface 135 of the transom bracket 133. Thus, when in the raised position, the propulsion unit 181 does not engage the transom 117 and does not extend forwardly above the top of the transom 117.

Various of the features of the invention are set forth in the following claims.

I claim:

1. A marine propulsion device comprising a bracket adapted to be fixed to the transom of a boat and including a mounting surface engaged with the boat transom when said bracket is boat mounted, said bracket also including a lower part having a lower bearing with a fixed steering axis which extends generally vertically when said bracket is boat mounted, a member including a lower portion extending in said lower bearing, and a pair of laterally spaced arms connected to said lower portion and respectively including upper horizontal bearings having a common axis located in spaced relation above said lower bearing, a steering arm fixed to said member for steerably rotating said member within said lower bearing about said generally vertical axis, a propulsion unit including a powerhead and a lower unit extending fixedly downwardly from said powerhead and including a rotatably mounted propeller, and means on said powerhead adjacent the top thereof and cooperating with said horizontal bearings for pivotally connecting said propulsion unit to said member for movement about the horizontal axis between a running position with said propeller submerged in water and with said propulsion unit located wholly aft of said bracket mounting surface and an elevated position with said propeller substantially out of the water and with said propulsion unit located wholly aft of said bracket mounting surface.

2. A marine propulsion device in accordance with claim 1 and further including extensible means extending between said member and said propulsion unit for displacing said propulsion unit about the horizontal axis.

3. A marine propulsion device in accordance with claim 1 wherein said transom bracket includes a central portion having therein an opening, wherein said powerhead includes a substantially watertight engine compartment having, adjacent the front thereof, an opening, and further including a flexible boot connected in watertight relation to said engine compartment so as to communicate through said engine compartment opening with the interior of said engine compartment and connected in watertight relation to said bracket central portion so as to communicate through said bracket central portion opening with the atmosphere forwardly of said bracket.

4. A marine propulsion device in accordance with claim 3 wherein said bracket central portion opening is located above said lower bearing.

5. A marine propulsion device in accordance with claim 1 wherein said generally vertical steering axis extends upwardly and forwardly.

6. A marine propulsion device in accordance with claim 1 wherein said generally vertical steering axis extends upwardly and rearwardly and intersects the horizontal axis.

7. A marine propulsion device in accordance with claim 1 wherein said powerhead is located, in part, between said laterally spaced arms of said member.

8. A marine propulsion device in accordance with claim 1 wherein transom bracket has an interior surface and an exterior surface, wherein said lower bearing communicates between said interior surface and said exterior surface, wherein said member comprises a yoke having a lower leg extending in said lower bearing and having a lower end, and wherein said steering arm is connected to said lower end of the leg and extends forwardly of said transom bracket.

9. A marine propulsion device in accordance with claim 8 wherein said lower part of said bracket includes a rearwardly open notch which separates said lower bearing into an upper part and a lower part, wherein a bushing is carried on said lower leg in said notch and includes oppositely laterally extending studs, and wherein said device further includes a pair of extensible members respectively pivotally connected to said studs and to opposite sides of said propulsion unit.

10. A marine propulsion device in accordance with claim 1 wherein said transom bracket also includes an upper part having an upper bearing in generally vertical alignment with said lower bearing, wherein said member includes an upper wall connecting said spaced arms and including an upper king pin extending through said upper bearing and having an upper end, wherein said member also includes a lower wall connecting said spaced arms, and wherein said lower portion comprises a lower king pin extending from said lower wall and located in said lower bearing.

11. A marine propulsion device in accordance with claim 10 wherein said member is open between said upper and lower walls and between said laterally spaced arms, and wherein said powerhead is located, in part, between said upper and lower walls and said laterally spaced arms.

12. A marine propulsion device in accordance with claim 10 wherein said transom bracket has an interior surface and an exterior surface, wherein said upper bearing has an upper end communicating with said interior surface, and wherein said steering arm is fixed to said upper end of said upper king pin and extends forwardly of said bracket.

13. A marine installation comprising a boat hull including a transom having therein an opening, and a marine propulsion device comprising a bracket having an interior surface and an exterior surface, one of said surfaces including a mounting surface fixed to said boat transom in encircling relation to said transom opening, and a central portion extending from said mounting surface and closing said transom opening, said transom bracket also including a lower part having a lower bearing with a fixed steering axis which extends generally vertically, a member including a lower portion extending in said lower bearing and a pair of laterally spaced arms connected to said lower portion and respectively including upper horizontal bearings having a common axis and located in spaced relation above said lower bearing, a steering arm fixed to said member for steerably rotating said member within said lower bearing about said generally vertical axis, a propulsion unit including a powerhead and a lower unit extending fixedly downwardly from said powerhead and including a rotatably mounted propeller, and means on said powerhead adjacent the top thereof and cooperating with said upper horizontal bearings for pivotally connecting said propulsion unit to said member for movement about the horizontal axis between a running position with said propeller submerged in water and with said propulsion unit located wholly aft of said bracket mounting surface and an elevated position with said propeller substantially out of the water and with said propulsion unit located wholly aft of said bracket mounting surface.

14. A marine propulsion installation in accordance with claim 13 and further including extensible means extending between said member and said propulsion unit for displacing said propulsion unit about the horizontal axis.

15. A marine propulsion installation in accordance with claim 13 wherein said transom bracket includes a central portion having therein an opening, wherein said powerhead includes a substantially watertight engine compartment having, adjacent the front thereof, an opening, and further including a flexible boot connected in watertight relation to said engine compartment so as to communicate through said engine compartment opening with the interior of said engine compartment and connected in watertight relation to said bracket central portion so as to communicate through said bracket central portion opening with the interior of said boat.

16. A marine propulsion installation in accordance with claim 15 wherein said bracket central portion opening is located above said lower bearing.

17. A marine propulsion installation in accordance with claim 13 wherein said generally vertical steering axis extends upwardly and forwardly.

18. A marine propulsion installation in accordance with claim 13 wherein said generally vertical steering axis extends upwardly and rearwardly and intersects the horizontal axis.

19. A marine propulsion installation in accordance with claim 13 wherein said transom bracket has an interior surface and an exterior surface, wherein said lower bearing communicates between said interior surface and said exterior surface, wherein said member comprises a yoke having a lower leg extending in said lower bearing and having a lower end, and wherein said steering arm is connected to said lower end of said leg and extends interiorly of said boat.

20. A marine propulsion installation in accordance with claim 19 wherein said lower part of said bracket includes a rearwardly open notch which separates said lower bearing into an upper part and a lower part, wherein a bushing is carried on said lower leg in said notch and includes oppositely laterally extending studs, and wherein said device further includes a pair of extensible members respectively pivotally connected to said studs and to opposite sides of said propulsion unit.

21. A marine propulsion installation in accordance with claim 13 wherein said transom bracket also includes an upper part having an upper bearing in generally vertical alignment with said lower bearing, wherein said member includes an upper wall connecting said spaced arms and including an upper king pin extending through said upper bearing and having an upper end, wherein said member also includes a lower wall connecting said spaced arms, and wherein said lower portion comprises a lower king pin extending from said lower wall and located in said lower bearing.

22. A marine propulsion installation in accordance with claim 21 wherein said member is open between said upper and lower walls and between said laterally spaced arms, and wherein said powerhead is located, in part, between said upper and lower walls and said laterally spaced arms.

23. A marine propulsion installation in accordance with claim 21 wherein said transom bracket has an interior surface and an exterior surface, wherein said upper bearing has an upper end communicating with said interior surface, and wherein said steering arm is fixed to said upper end of said upper king pin and extends forwardly of said bracket.

* * * * *